US005718802A

United States Patent [19]

Collier et al.

[11] Patent Number: 5,718,802

[45] Date of Patent: Feb. 17, 1998

[54] PROCESS FOR OBTAINING CELLULOSIC FIBER BUNDLES AT LEAST 2.5 CM LONG FROM PLANT STALK RIND

[75] Inventors: John R. Collier; Billie J. Collier, both of Baton Rouge, La.

[73] Assignee: Board of Supervisors of Louisiana State University and Agricultural and Mechanical College, Baton Rouge, La.

[21] Appl. No.: 370,226

[22] Filed: Jan. 9, 1995

Related U.S. Application Data

[63] Continuation of Ser. No. 976,551, Nov. 16, 1992, abandoned.

[51] Int. Cl.[6] ..... D21B 1/36

[52] U.S. Cl. ..... 162/21; 162/22; 162/25; 162/27; 162/96

[58] Field of Search ..... 162/21, 22, 25, 162/27, 68, 90, 96; 241/28

[56] References Cited

U.S. PATENT DOCUMENTS

| | | | |
|---|---|---|---|
| 2,639,988 | 5/1953 | Zeehuisen | 162/20 |
| 2,805,156 | 9/1957 | Payne et al. | 162/96 |
| 3,216,886 | 11/1965 | Katzen | 162/28 |
| 3,694,308 | 9/1972 | Botz | 162/55 |
| 4,662,836 | 5/1987 | Kelchner, Jr. | 425/223 |
| 4,857,145 | 8/1989 | Villavicencio | 162/96 |
| 4,908,099 | 3/1990 | Delong | 162/21 |
| 4,968,385 | 11/1990 | Amador et al. | 162/96 |

FOREIGN PATENT DOCUMENTS

| | | | |
|---|---|---|---|
| 30332 | 11/1930 | Australia | 162/21 |
| 553951 | 3/1958 | Canada | 162/21 |

OTHER PUBLICATIONS

Collier et al., "Textile fibers from sugar cane", ACPTC Proceedings, 1989, p. 27.

Collier et al., "Textile Fibers from Sugar Cane,"ACPTP Proceedings, p. 27 (1989).

Collier et al., Extraction and Evaluation of Fibers from Sugar Cane (unpublished; anticipated publication date in Textile Research Journal is Dec. 1992).

*Primary Examiner*—Peter Chin
*Assistant Examiner*—Dean T. Nguyen
*Attorney, Agent, or Firm*—John H. Runnels

[57] ABSTRACT

Novel fiber bundles may be produced as a by-product of sugar cane or other plants. These fiber bundles may be spun into a yarn, or formed into a non-woven mat. The non-woven mat is useful, for example, as a biodegradable geotextile for inhibiting erosion while allowing plants to become established on roadsides, or in other applications. Sugar cane fiber bundles were extracted from the Tilby-separated rind of cane stalks using alkaline treatments. The amount of lignin removed was dependent on alkaline concentration and time, pressure of treatment, and steam explosion conditions if employed. Agitation and vigorous boiling affected the lignin removal. Alkali concentration significantly affected the mechanical properties of the fiber bundles. Tenacity, toughness, and linear density were higher for the fibers extracted at lower alkali concentration. Bending rigidity and hysteresis of these fibers were also higher. This process is also expected to work with other plant stalks having a high lignin content.

24 Claims, No Drawings

PROCESS FOR OBTAINING CELLULOSIC FIBER BUNDLES AT LEAST 2.5 CM LONG FROM PLANT STALK RIND

This application is a continuation of application Ser. No. 07/976,551, filed Nov. 16, 1992 now abandoned.

This invention pertains to geotextiles, other textiles, and fibers, particularly to geotextiles, other textiles, and fibers which may, for example, be produced as a by-product of sugar cane processing.

Sugar cane is produced in large quantities in several southern states and in Hawaii in the United States, and in tropical or semitropical climates in many other countries. In the most common type of processing currently used, the cane stalks are crushed to extract sugar-containing juices, and the crushed stalks, or bagasse, are then used for fuel, for mulch, or are simply discarded. Attempts to find economical uses for bagasse have not been particularly successful. Bagasse has been compressed and used in-house as a fuel by cane processors. It has also been used in paper board and particle board, but in these applications bagasse has not been competitive with similar products made from other sources. Various uses of bagasse are discussed, for example, in Paturau, J. M., By-Products of the Sugar Cane Industry (3rd ed. 1989).

No known prior work reports the production of cellulosic fiber bundles from sugar cane (or other plants) having the length and characteristics obtained by the process of the present invention. No known prior work discusses the partial delignification and controlled mechanical agitation of sugar cane rind to produce fibers suitable for spinning yarn or for making non-woven mats.

Textile fibers from the stalks or stems of plants are generally extracted by retting (biological action) or by treatment with chlorine compounds. Fibers from bagasse may be of a diameter similar to those of fibers from plants more traditionally used for making textiles, but the bagasse fibers are much shorter. Bagasse fibers are too short to be spun into yarns, and are likewise too short to form a mat of adequate structural integrity. They have been used to make paper and wall boards since they are similar in size to wood fibers.

Grasses such as sugar cane are monocotyledons, having parallel veined leaves. The sugar cane stalk has an outside rind and an inner pith. The inner pith contains short fibers and the majority of the sucrose, while the rind contains longer and finer fibers. Sugar cane rind contains, in addition to cellulosic fibers, approximately 18% lignin and 30% hemicelluloses. Bundles of fibers are arranged randomly throughout the plant stem. The vascular fiber bundles in sugar cane are widely spaced in the inner part of the stalk, but are smaller and closer together in the outer rind.

The vascular fiber bundles are comprised of different types of cells. The parenchyma cells surrounding the bundles are short and thin-walled. The more fibrous cells, the sclerenchyma cells, are longer and have thicker walls. Both types are bound together by encrusting materials, mainly lignin and hemicellulose, which make up the middle lamella of the bundles.

In the traditional type of cane processing which produces bagasse as a by-product, the entire stalk is crushed, breaking up the fibers in the rind.

In the newer Tilby separation process, introduced in the 1970's, the cane is cut into pieces which are split longitudinally, and the pith is routed out. See Bourzutschky et al., Cane Separation—Its Integration into the Conventional Sugar Industry, Zuckerind, Vol. 115, No. 2, pp 111–116 (1990), the entire disclosure of which is incorporated by reference. The rind, and therefore the longer fibers in the rind, remain uncrushed. Although bagasse is not, in general, a by-product of the Tilby process, in most current separation processes the rind pieces are further crushed to process into products such as charcoal briquettes, paper and particle board. The original rationale behind the Tilby process is that it separates the rind from the pithy core which contains high-quality sucrose. Therefore less purification of the core extract is needed to obtain table-ready sugar.

The rind obtained from commercial applications of the Tilby process has previously been used as a boiler feed (as has bagasse), and as a raw material for producing charcoal. As is the case with bagasse, the rind can be used as a paper or wall board fiber source.

Collier et al., "Textile Fibers from Sugar Cane," ACPTP Proceedings, p. 27 (1989) describes some of the characteristics of fibers obtained by processing sugar cane in a Tilby separator, boiling rind pieces in an alkaline solution for twenty-four hours, and peeling fibers off the softened stalks. No means for producing textile-quality fibers are disclosed, nor are there any suggestions to use partial delignification or limited mechanical action to achieve such a result. That abstract concluded that further work was needed on more efficient extraction methods for obtaining purified cellulose fibers, but gave no suggestions on the direction such further work might take.

In the present invention, a novel method of extracting fiber bundles from cane rind has been discovered which partially frees the fiber bundles from the materials encrusting them, but which does not reduce them to ultimate fibers. The resulting fiber bundles are suitable for various textile applications, as they are sufficiently long and flexible to be spun into yarn, or to be formed directly into non-woven mats. The yarn can be knitted or woven into a fabric. If a non-woven mat is formed, it may be used in applications such as making a biodegradable geotextile.

It has been discovered that when cut lengths of cane rind are subjected to limited mechanical action, such as oscillatory agitation (but preferably not complete rotatory agitation), vigorous boiling, or steam explosion, accompanied by partial chemical delignification, the length of the fiber bundles can be kept at nearly the length of the cut rind. Therefore, bundles of fibers may be produced which are similar in length to those of cotton (2.5 to 5 cm), or even longer. The lignin and hemicelluloses in the rind appear to act as natural adhesives binding the "ultimate" fibers together. These ultimate fibers in sugar cane rind are 2 to 3 mm long, similar to those of jute and wood. However, the use of limited mechanical action allows the production of fiber bundles having a length nearly equal to the length of the cut rind, and yet having a reduced cross section, a cross section similar to that of other useful cellulosic fibers.

Controlled rapid passage of gas bubbles through the reacting mixture (and therefore churning of the mixture) would also be expected to provide a possible means of achieving the limited mechanical action used in this invention. Another means would be the transport through, and simultaneous reaction in the channel of, a helical screw or screws rotating in an enclosed barrel (i.e. similar to screw extruders). If complete rotatory action is used, such as that from a stirrer and shaft, the fiber bundles tend to wrap around the rotating members and are reduced in length.

In contrast with the present invention, when full alkaline delignification procedures were used on cane rind, the resulting ultimate fibers were found to be similar to those found in bagasse or wood, about 2 to 3 mm long—too short for spinning into yarn or for making non-woven mats with sufficient structural integrity for practical applications. These ultimate fibers are too short to be suitable for most textile applications.

The most commonly used current process for delignification of wood fibers, the "full Kraft process," employs sulfur-containing chemicals which can cause air and water environmental problems. By contrast, controlled delignification in accordance with the present invention may be performed with alkali treatment alone (i.e., no sulfur-containing chemicals are required), coupled with limited mechanical action.

Ropes, yarn, woven fabrics, and knit fabrics can be made from sugar cane fibers made in accordance with the present invention, or from blends of these fibers with other fibers such as cotton. Biodegradable, non-woven geotextiles for erosion control on roadsides and elsewhere can be formed by discharging the cane fibers directly from the delignification reactor onto a flat surface for drying. Non-woven mats may also be made from batts of carded cane fiber bundles.

The Tilby process produces segments of sugar cane rind having controlled lengths which are typically much longer than the fibers found in bagasse. Thus initial processing of sugar cane in accordance with the Tilby process is a preferred means of obtaining lengths of sugar cane rind for use in the present invention. The rind is cut to predetermined lengths, and is then partially delignified using an alkaline process.

An optional step involves the use of steam explosion, which can lessen the severity of the chemical treatment otherwise needed, or perhaps eliminate the need for chemical pretreatment altogether. No prior process is known in which textile fibers have been produced by steam explosion. Steam explosion typically employs the introduction of medium- to high-pressure steam directly into the reaction chamber. After the temperature of the rind, and of the moisture in the rind, has been raised to a point above the atmospheric boiling point, the pressure is abruptly dropped to one atmosphere (or lower). The rapid vaporization of moisture in the rind causes the rind to explode into smaller fragments. Due to its structure, the rind splits more easily in the longitudinal direction than in the lateral direction. Therefore the resulting fragments tend to retain the length of the rind, while being reduced in width. If sufficient explosive force is developed, or if appropriate chemical treatment has preceded the steam treatment, the rind may be reduced to fiber bundles. Steam explosion alone can result in the partial removal of lignin, even without chemical pretreatment.

In an embodiment of the present invention, fresh sugar cane stalks from Louisiana fields were first thoroughly washed to remove soil and other foreign material. The cleaned stalks were processed with a Tilby Cane Separator to remove the pith, which was discarded. (In a commercial application the high-quality-sucrose-containing pith would generally be used to produce sugar products.) The rind was then cut above and below the nodes of the stalk to eliminate the nodal regions, which have a different morphology from the remainder of the stalk. The lengths of rind were cut into sections 4 cm long and 1–2 mm wide to facilitate the extraction of fibers. The waxy epidermal layer of these pieces was removed with a scalpel; the rind pieces were immersed in water at a temperature of 85° to 150° C. for thirty to sixty minutes to remove the easily extracted sugars and coloring matter. In a commercial scale process, the nodal regions of the stalks would not necessarily be excluded, and the wax could be removed by other means, such as burning the cane in the field.

Solutions of sodium hydroxide were used to extract partially the lignin and other binding materials from the rind structure to free the fibers. Alkaline concentration and extraction conditions were varied to determine their effects on the fibers obtained. Alternative treatments were also used: high pressure alkali, or an atmospheric pressure alkaline boil. The high pressure extraction was carried out at 2 atmospheres and 121° C., for one hour or two hours, using one of two different concentrations of alkali, 0.1N or 1.0N. The same two concentrations of alkali were used in the atmospheric extraction, where times of one hour and four hours were employed. Agitation was used in the atmospheric treatment to enhance the separation of the fibers. For all treatments, 100 mL of alkaline solution were used to extract one gram of rind.

The amount of lignin extracted during the various treatments was determined by measuring the ultraviolet absorbance of dioxane solutions of the extracted lignin. The alkaline extract was neutralized with mineral acid, the precipitated lignin was dissolved in dioxane, and the ultraviolet absorbance of the solution was measured at 281 nm.

Characterization of the fibers extracted by each procedure included measurements of ultimate fiber length, tensile properties, and bending properties, as well as microscopic observation. Fiber lengths were measured with a Zeiss Interactive Digital Analysis System. The tensile properties of the fiber bundles were measured on an Instron Model 1122 tensile tester. Fiber bundles were placed in Pressley clamps, which were mounted in the Instron jaws with a gage length of 3.2 mm. Modulus, breaking force, tenacity, toughness, and strain were measured (ASTM). Bending properties were determined on a Kawabata Pure Bending Tester, using an adapted technique for mounting fibers. See generally Collier et al., Bending of Internally Reinforced Rayon Fibers, J. Textile Inst., vol. 82, pp 42–51 (1991).

Longitudinal surfaces and cross-sectional cuts of the fiber bundles were observed with a Cambridge S-260 scanning electron microscope (SEM) and with an ElectroScan ESEM E3. The fibers were cut with a razor blade, and were then mounted on stubs which could be tilted and rotated so that both longitudinal and cross-sectional surfaces could be observed. The pieces of fiber which had been subjected to the tensile test were also observed microscopically.

Lignin Determination

Table I presents the results of the lignin analysis of the alkaline extracts.

TABLE I

Lignin removed in alkaline extraction

| Pressure (atm) | NaOH Concentration (N) | Time (hr) | Lignin removed (g lignin/ g rind) | Duncan grouping* |
|---|---|---|---|---|
| 1 | 1.0 | 4 | 0.146 | A |
| 1 | 0.1 | 4 | 0.121 | B |
| 2 | 1.0 | 2 | 0.108 | C |
| 2 | 1.0 | 1 | 0.101 | D |
| 2 | 0.1 | 2 | 0.085 | E |
| 1 | 1.0 | 1 | 0.075 | F |
| 2 | 0.1 | 1 | 0.064 | G |
| 1 | 0.1 | 1 | 0.054 | H |

*Entries with the same letter are not significantly different at the 0.05 level.

In general, the amount of lignin removed depended on the severity of the extraction conditions. More lignin was removed at the higher alkaline concentration. For the atmospheric extraction, more lignin was removed at longer treatment times. Treatment time did not appear to have as great an effect on lignin removal in the high pressure extraction. Analysis of variance (ANOVA) showed that concentration, time, and pressure each significantly affected the amount of lignin removed, although pressure was not as significant as the other two factors. A post-ANOVA analysis (Duncan's Multiple Range Test), treating each combination of extraction conditions as a separate group, showed that the lignin removed in each group differed significantly. Longer times at atmospheric pressure, and higher concentrations at both pressures increased the amount of lignin removed from the cane rind. More lignin was removed at atmospheric pressure than under higher pressure conditions. This result was probably due to the stirring action used in the atmospheric extraction treatments, but not in the high pressure treatments. (The configuration of the closed system used in the examples reported here did not permit a stirrer to be present.) Further, during the delignification at one atmosphere, it was observed that the boiling was vigorous and that after some time separated fibers rose and floated on top of the froth. This vigorous boiling, which did not occur in the high pressure treatment, created additional mechanical action which apparently aided in separation of the fibers. (Closed-pressure vessels do not permit vigorous boiling, because the volume cannot expand significantly.)

Size of Fibers

The mean length of the ultimate cells in the fibers was measured, as was the linear density of the fiber bundles. The fiber bundles were separated into ultimate cells before measurement of length under the microscope. The length of the ultimate cells was approximately 2 mm. The length of the ultimate cells was not affected by the extraction process.

However, extraction conditions did affect the linear density of the fiber bundles, indicating that fiber bundle size can be controlled. See Table II. Alkaline extraction concentration was the most significant factor. Fibers extracted with 0.1N NaOH had significantly higher rex values than those treated with the stronger alkaline solution. (The SI unit for fiber and yarn size is the "tex," the mass in grams of one kilometer of the fiber.) The tex values are relatively high, indicating that these extracted fiber bundles are similar in size to those of abaca, sisal, and henequen. Fiber bundles having linear densities around 2 tex, and lengths in excess of 10 cm have been obtained. The tex values were observed to depend on the operating conditions: the pretreatment time and temperature; the alkaline treatment concentration, time and temperature; the degree of agitation used; and the steam explosion conditions, if used.

TABLE II

Linear density of fiber bundles

| Pressure (atm) | NaOH Concentration (N) | Time (hr) | Linear Density (tex) | Duncan grouping[a] |
|---|---|---|---|---|
| 1 | 0.1 | 1 | 54.2 | A |
| 2 | 0.1 | 1 | 49.8 | A |

TABLE II-continued

Linear density of fiber bundles

| Pressure (atm) | NaOH Concentration (N) | Time (hr) | Linear Density (tex) | Duncan grouping[a] |
|---|---|---|---|---|
| 1 | 0.1 | 4 | 48.4 | A |
| 2 | 0.1 | 2 | 48.1 | A |
| 2 | 1.0 | 1 | 25.8 | B |
| 1 | 1.0 | 1 | 24.4 | B |
| 1 | 1.0 | 4 | 22.5 | B |
| 2 | 1.0 | 2 | 21.8 | B |

[a]Entries with the same letter are not significantly different at the 0.05 level.

SEM Observation

SEM observation of the extracted fibers generally confirmed the lignin results, and also was consistent with the mechanical property measurements described below. Fibers that had undergone milder treatments, with lower alkali concentrations and shorter treatment times, retained more encrusting materials between the ultimate cells. Cross-sectional views showed extensive material surrounding the hollow fiber cells. Longitudinal views showed the outside of the bundles to be composed mainly of short, thin walled parenchyma cells.

As the severity of the treatment was increased, and more lignin was removed, fewer of the shorter cells were seen around the fiber bundle, and the longer, thick walled, sclerenchyma cells became more apparent. Less of the binding lignin was seen between the cells in the cross-section. The longitudinal view revealed few of the shorter, fatter cells, and the bundles appeared to be composed mainly of the longer ultimate cells.

Tensile Properties

Alkaline extraction conditions significantly affected the tenacity, elongation, and toughness values of the extracted fiber bundles. Tenacity and energy to break were dependent on NaOH concentration, with the higher concentration significantly lowering these values. As shown in Table III, which presents the results of Duncan's Multiple Range Test, for each concentration only small differences were seen in tenacity and toughness at different times and pressures. Even though more lignin was removed under atmospheric pressure conditions, the higher pressure treatment had a more deleterious effect on fiber strength. The most severe extraction conditions resulted in the weakest fibers.

TABLE III

Tensile properties of fiber bundles

| Pressure (atm) | NaOH Concentration (N) | Time (hr) | Tenacity (mN/tex) | Duncan grouping[a] | Strain (%) | Duncan grouping[a] | Energy to break (mJ) | Duncan grouping[a] |
|---|---|---|---|---|---|---|---|---|
| 1 | 0.1 | 4 | 287 | A | 10.3 | AB | 1.92 | A |
| 1 | 0.1 | 1 | 287 | A | 9.2 | ABC | 1.96 | A |
| 2 | 0.1 | 2 | 241 | AB | 7.4 | CD | 1.50 | A |
| 2 | 0.1 | 1 | 237 | AB | 8.7 | BC | 1.69 | A |
| 1 | 1.0 | 1 | 219 | B | 5.5 | D | 0.66 | B |
| 1 | 1.0 | 4 | 212 | BC | 11.8 | A | 0.77 | B |
| 2 | 1.0 | 1 | 159 | C | 9.4 | ABC | 0.72 | B |
| 2 | 1.0 | 2 | 156 | C | 9.3 | ABC | 0.48 | B |

[a]Entries with the same letter are not significantly different at the 0.05 level.

There was no consistent effect of the extraction conditions on the calculated breaking strain of the fibers. The highest mean strain was exhibited by the fibers extracted with the higher alkaline concentration for 4 hours at atmospheric pressure, while the lowest strain was found in the fibers extracted with the high concentration for 1 hour at atmospheric pressure.

The tenacity values ranged from 0.16N/tex to 0.29N/tex. The lower values, for fibers extracted with 1.0N NaOH, were similar to those of rayon and weaker cotton fibers. The higher tenacity values for the cane fibers approached those for jute. Strain values for cane fibers were higher than those for most other cellulosic fibers, giving toughness values which were similar or higher. Work factors, calculated as suggested by Morton et al., Physical Properties of Textile Fibres (2nd ed., 1975), were approximately 0.5, similar to the values for other cellulosic fibers.

The broken fiber bundles were observed with the SEM to study the mode of failure for fiber bundles extracted with 0.1N NaOH at one and two atmospheres. The edges were jagged and irregular, indicating that the load was shared by the ultimate fibers and the cementing lignin and hemicelluloses. The fractures were not even across the cross-sectional plane of the bundle, but were spread over some distance along the length. There was partial slippage of some of the ultimate fibers before bundle failure, probably caused by failure of the middle lamella. The ultimate fibers became unbonded and then failed as they were forced to bear the load. The break was more jagged for the milder, one atmospheric, treatment.

More severe treatments produced fibers with a more even fracture. These fiber bundles, extracted with 1.0N NaOH, broke across the plane of the fiber bundle, as indicated by the less jagged appearance of the fragments. More lignin was removed from these fibers, and the tensile load was born mainly by the ultimate fibers. The fibers treated at the higher pressure had a cleaner break, and also had the lowest tenacity.

Bending Properties

Bending rigidity and hysteresis of the extracted fiber bundles were measured on a Kawabata Pure Bending Tester. The effect of different extraction conditions on bending properties paralleled the effect of the extraction conditions on lignin: fibers extracted under conditions which removed the most lignin generally had lower bending rigidity, and lower hysteresis. See Table IV.

TABLE IV

Bending properties of fiber bundles

| Pressure (atm) | NaOH Concentration (N) | Time (hr) | Bending rigidity ($gf \cdot cm^2$/fiber bundle) | Duncan grouping[a] | Specific flexural rigidity ($mN \cdot mm^2/tex^2$) | Bending hysteresis ($gf \cdot cm$/fiber bundle) | Duncan grouping[a] |
|---|---|---|---|---|---|---|---|
| 2 | 0.1 | 1 | 0.411 | A | 0.162 | 0.768 | A |
| 2 | 0.1 | 2 | 0.383 | A | 0.162 | 0.806 | A |
| 1 | 0.1 | 4 | 0.309 | B | 0.129 | 0.636 | AB |
| 1 | 0.1 | 1 | 0.288 | B | 0.096 | 0.573 | B |
| 2 | 1.0 | 2 | 0.188 | C | 0.386 | 0.388 | C |
| 1 | 1.0 | 1 | 0.205 | C | 0.259 | 0.327 | C |
| 1 | 1.0 | 4 | 0.157 | C | 0.364 | 0.397 | C |
| 2 | 1.0 | 1 | 0.157 | C | 0.231 | 0.379 | C |

[a]Entries with the same letter are not significantly different at the 0.05 level.

ANOVA of these data revealed that the most significant effect was due to concentration, with those fibers extracted at lower alkali concentrations exhibiting both higher stiffness and higher hysteresis. A Duncan's means separation test following ANOVA showed the effect of alkali concentration on bending, with all of the fibers extracted with 0.1N NaOH exhibiting higher bending rigidity and higher hysteresis. At this lower concentration of alkali, the atmospheric pressure treatment gave fibers with lower bending rigidity. More lignin was removed during this treatment than was removed with the higher pressure treatment. This result is believed to be due to the higher mechanical action present in the atmospheric pressure treatment. The greater lignin removal affected both bending resistance and tensile properties. Dividing bending rigidity by the square of the linear density gives specific flexural rigidity. As shown in Table IV, the specific flexural rigidity was somewhat sensitive to NaOH concentration, but was comparable to that for rayon or nylon. The values for the fibers extracted at 0.1N NaOH were lower, indicating that the higher absolute rigidities for these fibers were not due to fiber size alone.

As indicated by the effects of reaction conditions on the properties of the resulting fiber bundles, the reaction conditions used may be chosen to tailor the properties of the fiber bundles as appropriate for use in a particular application.

To prepare the fiber bundles for spinning, the fiber bundles should be separated without significantly reducing their length. This has been accomplished by drying, separating and combing. However, in a preferred method wet clumps of fiber bundles from the reactor were discharged into a fluidizing gas stream-passing countercurrent to the bundles in a vertical tube. In the tube the bundles were dried while suspended in the fluidized bed. When the bulk density was sufficiently reduced by the evaporation of water, the dry bundles were pneumatically conveyed out of the bed into a larger diameter collection chamber. Alternatively, steam explosion into an open environment may also be used to obtain separated fiber bundles.

When the fiber bundles were discharged from the reactor, or were stored wet, and were then deposited onto a flat surface and allowed to dry in contact with one another, a non-woven mat was formed. Non-woven mats were also formed by steam explosion of the fiber bundles onto a restraining surface. The bundles had sufficient adhesion that the mat developed structural integrity upon drying. The bulk density and opacity of such mats may be tailored by controlling the deposition of the bundles onto the surface. Mats for geotextile uses can be formed having sufficient openness for sunlight to pass through and for plants to penetrate, while maintaining sufficient integrity to inhibit erosion significantly. Because the mats are composed of organic materials (primarily cellulose with some remaining lignin), they will eventually biodegrade.

It is expected that the process described here will also be applicable or adaptable for obtaining cellulosic fibers or fiber bundles from plant sources other than sugar cane. Suitable sources for such fibers may include one or more of the following: kenaf, bamboo, milkweed, bast fiber plants, and other plants with stalk fibers having a rigid rind and a high lignin content; i.e., a lignin content after processing which is sufficient to bind the ultimate fibers into fiber bundles which have useful textile properties.

The entire disclosure of the following unpublished galley proof is incorporated by reference: Collier et al., Extraction and Evaluation of Fibers from Sugar Cane (unpublished; anticipated publication date in Textile Research Journal is December 1992).

We claim:

1. A process for obtaining cellulosic fiber bundles at least 2.5 centimeters long from lengths of sugar cane rind, comprising the simultaneous steps of:

(a) partially delignifying the rind; and (b) subjecting the rind to limited mechanical action;

wherein said partial delignifying step and said limited mechanical action step suffice to obtain cellulosic fiber bundles from the rind, but are insufficient to reduce the cellulosic fiber bundles to ultimate fiber cells; and wherein sufficient lignin remains in the cellulosic fiber bundles following said partial delignifying step and said limited mechanical action step to bind the fiber cells into fiber bundles at least 2.5 centimeters long.

2. A process as recited in claim 1, wherein said partial delignifying step comprises treating the rind with alkali and heat.

3. A process as recited in claim 1, wherein said limited mechanical action step comprises oscillatory agitation, vigorous boiling, rapid passage of gas bubbles through the rind, or passage through a rotating helical screw.

4. A process as recited in claim 1, wherein said partial delignifying step comprises treating the rind with alkali and heat; and wherein said limited mechanical action step comprises oscillatory agitation, vigorous boiling, rapid passage of gas bubbles through the rind, or passage through a rotating helical screw.

5. A process as recited in claim 1, wherein said limited mechanical action step comprises impregnating the rind with steam; and abruptly reducing the pressure applied to the rind, at a temperature above the boiling point of water at the reduced pressure; whereby at least some of the moisture in the rind explodes into steam, thereby fragmenting the rind.

6. A process for preparing a non-woven mat of cellulosic fiber bundles, comprising the steps of:

(a) obtaining cellulosic fiber bundles by the process recited in claim 1; and (b) allowing the fiber bundles to dry in contact with one another;

whereby a non-woven mat of the fiber bundles is formed.

7. A non-woven mat of cellulosic fiber bundles produced by the process of claim 6.

8. A process for obtaining cellulosic fiber bundles at least 2.5 centimeters long from lengths of a plant stalk rind which has a high lignin content, wherein the rind comprises cellulosic fiber bundles comprising ultimate fiber cells which are substantially smaller than said fiber bundles, comprising the simultaneous steps of:

(a) partially delignifying the rind; and (b) subjecting the rind to limited mechanical action;

wherein said partial delignifying step and said limited mechanical action step suffice to obtain cellulosic fiber bundles from the rind, but are insufficient to reduce the cellulosic fiber bundles to ultimate fiber cells; and wherein sufficient lignin remains in the cellulosic fiber bundles following said partial delignifying step and said limited mechanical action step to bind the fiber cells into fiber bundles at least 2.5 centimeters long.

9. A process as recited in claim 8, wherein the plant from which the rind is derived is kenaf, bamboo, milkweed, or a bast fiber plant having a high lignin content.

10. A process as recited in claim 9, wherein the plant from which the rind is derived is kenaf.

11. A process as recited in claim 9, wherein said partial delignifying step comprises treating the rind with alkali and heat.

12. A process as recited in claim 8, wherein said limited mechanical action step comprises oscillatory agitation, vigorous boiling, rapid passage of gas bubbles through the rind, or passage through a rotating helical screw.

13. A process as recited in claim 8, wherein said partial delignifying step comprises treating the rind with alkali and heat; and wherein said limited mechanical action step comprises oscillatory agitation, vigorous boiling, rapid passage of gas bubbles through the rind, or passage through a rotating helical screw.

14. A process as recited in claim 8, wherein said limited mechanical action step comprises impregnating the rind with steam; and abruptly reducing the pressure applied to the rind, at a temperature above the boiling point of water at the reduced pressure; whereby at least some of the moisture in the rind explodes into steam, thereby fragmenting the rind.

15. A process for preparing a non-woven mat of cellulosic fiber bundles, comprising the steps of:

(a) obtaining cellulosic fiber bundles by the process recited in claim 8; and (b) allowing the fiber bundles to dry in contact with one another;

whereby a non-woven mat of the fiber bundles is formed.

16. A non-woven mat of cellulosic fiber bundles produced by the process of claim 15.

17. A process for obtaining cellulosic fiber bundles at least 2.5 centimeters long from lengths of sugar cane rind containing moisture, comprising the steps of:

(a) placing the rind in a closed reaction chamber, and heating the rind and the moisture in the rind under pressure to a temperature above 100° C.; and abruptly reducing the pressure in the reaction chamber to one atmosphere or less, causing the explosion of at least some of the moisture in the rind into steam;

wherein the steam explosion has a force which is sufficient to fragment the rind and to obtain cellulosic fiber bundles from the rind, but which is insufficient to reduce the cellulosic fiber bundles to ultimate fiber cells; and wherein sufficient lignin remains in the cellulosic fiber bundles following the steam explosion to bind the fiber cells into fiber bundles at least 2.5 centimeters long.

18. A process for preparing a non-woven mat of cellulosic fiber bundles, comprising the steps of:

(a) obtaining cellulosic fiber bundles by the process recited in claim 17; and (b) allowing the fiber bundles to dry in contact with one another;

whereby a non-woven mat of the fiber bundles is formed.

19. A non-woven mat of cellulosic fiber bundles produced by the process of claim 18.

20. A process for obtaining cellulosic fiber bundles at least 2.5 centimeters long from lengths of a plant stalk rind which contains moisture and which has a high lignin content, wherein the rind comprises cellulosic fiber bundles comprising ultimate fiber cells which are substantially smaller than said fiber bundles, comprising the steps of:

(a) placing the rind in a closed reaction chamber, and heating the rind and the moisture in the rind under pressure to a temperature above 100° C.; and (b) abruptly reducing the pressure in the reaction chamber to one atmosphere or less, causing the explosion of at least some of the moisture in the rind into steam;

wherein the steam explosion has a force which is sufficient to fragment the rind and to obtain cellulosic fiber bundles from the rind, but which is insufficient to reduce the cellulosic fiber bundles to ultimate fiber cells; and wherein sufficient lignin remains in the cellulosic fiber bundles following the steam explosion to bind the fiber cells into fiber bundles at least 2.5 centimeters long.

21. A process as recited in claim 20, wherein the plant from which the rind is derived is kenaf, bamboo, milkweed, or a bast fiber plant having a high lignin content.

22. A process as recited in claim 21, wherein the plant from which the rind is derived is kenaf.

23. A process for preparing a non-woven mat of cellulosic fiber bundles, comprising the steps of:

(a) obtaining cellulosic fiber bundles by the process recited in claim 20; and (b) allowing the fiber bundles to dry in contact with one another;

whereby a non-woven mat of the fiber bundles is formed.

24. A non-woven mat of cellulosic fiber bundles produced by the process of claim 23.

* * * * *